United States Patent [19]

Schneider

[11] Patent Number: 4,494,696

[45] Date of Patent: Jan. 22, 1985

[54] UNIT INJECTOR

[75] Inventor: Michael J. Schneider, Huntington Woods, Mich.

[73] Assignee: The Bendix Corporation, Southfield, Mich.

[21] Appl. No.: 507,329

[22] Filed: Jun. 24, 1983

[51] Int. Cl.[3] ..... F02M 47/02

[52] U.S. Cl. ..... 239/90; 239/125

[58] Field of Search ..... 239/88–92, 239/95, 124, 125

[56] References Cited

U.S. PATENT DOCUMENTS 4,281,792 8/1981 Sisson et al. ..... 239/90 X 4,402,456 9/1983 Schneider ..... 239/90

*Primary Examiner*—Andres Kashnikow

*Attorney, Agent, or Firm*—Markell Seitzman; Russel Wells

[57] ABSTRACT

An injector including a self-actuating three-way valve lodged in a passage between the fuel injector supply inlet and a control valve. The three-way valve permits fuel to flow from supply through to the control valve during a metering mode of operation while prohibiting fuel to be dumped to the supply line during the pre-injection timing phase of operation.

5 Claims, 3 Drawing Figures

Fig-1
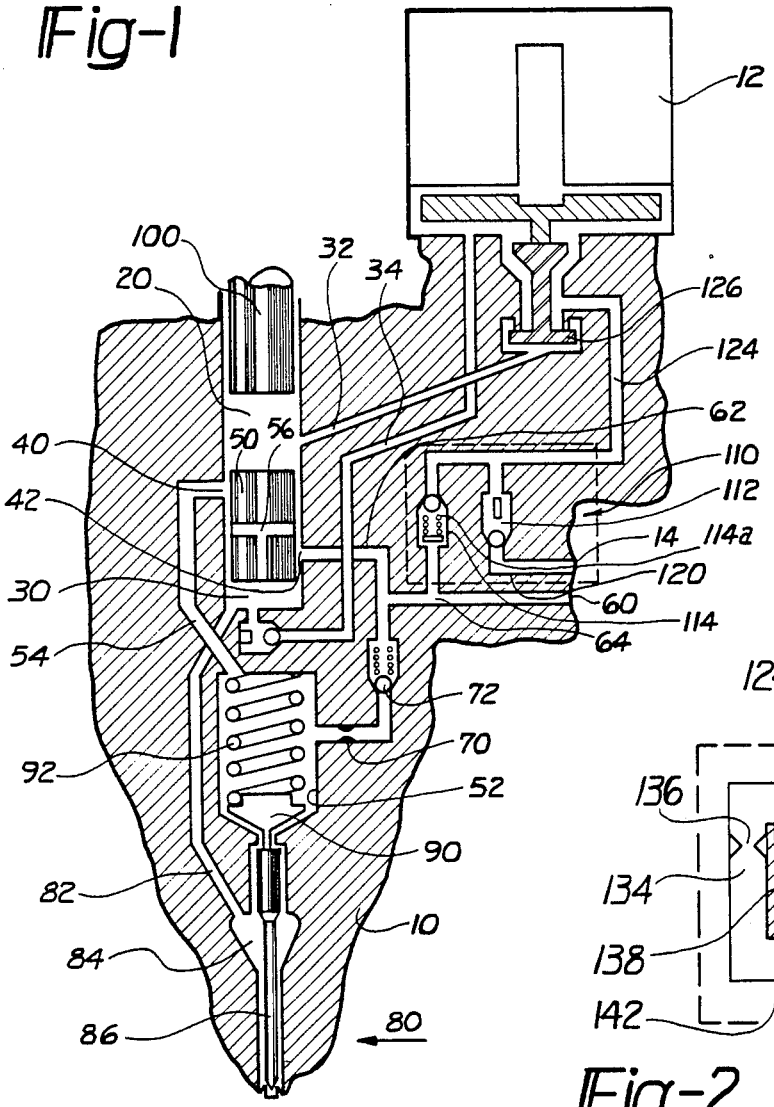
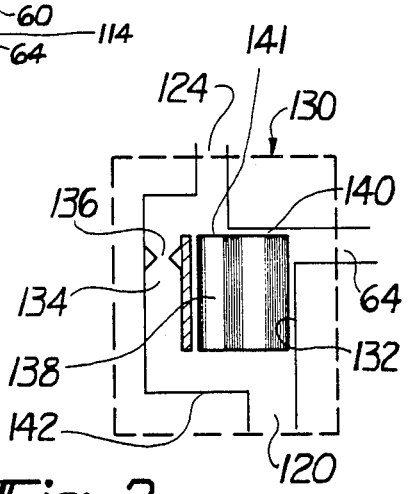
Fig-2
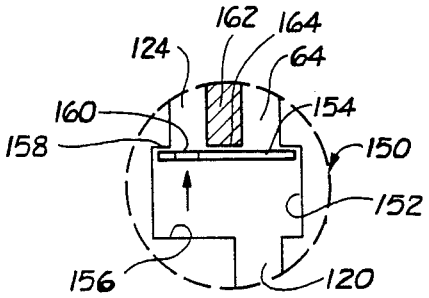
Fig-3

UNIT INJECTOR

BACKGROUND AND SUMMARY OF THE INVENTION

This invention relates generally to electrically controlled unit injectors. Sisson et al in U.S. Pat. No. 4,281,792 illustrates an electrically controlled unit injector capable of controlling the timing and metering functions by a single solenoid. This injector may be characterized as having four modes of operation. A preinjection timing mode, an injection mode, a fuel dumping mode and a metering mode. This type of unit injector utilizes a cam driven pumping piston or plunger and a floating or metering plunger both situated within a bore. The metering piston is hydraulically coupled to the pumping plunger. The volume of the bore between the two plungers defines a variable volume timing chamber and the volume below the metering plunger defines a metering chamber. Fuel is received into the timing chamber under the control of a solenoid valve. Sisson et al illustrates the use of a two-way valve with fuel input to the metering chamber directly from the fuel supply. Other embodiments have shown the utilization of a three-way valve which selectively controls the flow of fuel from the supply to either the timing and metering chambers. During the pre-injection timing phase of operation, the timing valve is maintained in a condition to permit the pumping piston to force fuel out of the timing chamber, through the control valve and back to supply. Fuel injection systems often utilize a plurality of similar injectors connected to a common fuel supply, the pumping of the fuel from the timing chamber of each unit injector may cause pressure and flow variations to occur within the supply line, thus degrading the fuel injection accuracy of the remaining injectors.

The present invention is directed to a means for eliminating supply pressure dynamics generated by a fuel pulse which is created by pumping the timing chamber fuel back into the supply line during the pre-injection timing mode of operation.

Accordingly, the present invention comprises in combination: an injector having the self-actuating three-way valve lodged in a passage between the fuel injector supply inlet and the control valve. This three-way valve permits fuel to flow from supply through to the electronic control valve during the metering mode of operation while prohibiting fuel to be dumped on to the supply line during the pre-injection timing phase of operation.

BRIEF DESCRIPTION OF THE DRAWINGS

In the drawings:

FIG. 1 illustrates a unit injector embodying the present invention.

FIGS. 2 and 3 illustrate alternate self-actuating three-way valves.

DETAILED DESCRIPTION OF THE DRAWINGS

Reference is now made to FIG. 1 which illustrates an electrically controlled unit injector having a single solenoid control valve 12. The solenoid valve 12 controls the flow of fuel from a supply 14 to the timing chamber 20 and metering chamber 30 of the unit injector. The unit injector further comprises a plurality of passages 32, 34 which carry fuel between the supply and the timing and metering chambers. In addition, the unit injector 10 further includes a timing chamber dump port 40 and a metering chamber dump 42 which permits the fuel in the timing chamber 20 to be dumped therefrom as the position of a floating or metering piston 50 is moved downwardly. In the embodiment of the invention illustrated in FIG. 1, the timing chamber 20 is dumped to a spring cage 52 through passage 54. The metering chamber 30 is dumped through passages 56 fabricated within the metering piston to drain 60 through the passages 62 and 64. The fuel within the spring cage 52 is similarly dumped to drain through an orifice 70 and check valve 72 combination. The injector 10 further includes a nozzle 80 of a known variety, situated remote from the metering and timing chambers. A passage 82 communicates fuel to a chamber 84 surrounding a needle valve 86. The needle valve 86 is supported within the injector 10 by a seat 90 which is biased downwardly by a spring 92. The unit injector 10 as described is similar to those described in U.S. Pat. No. 4,281,792 and in my U.S. patent application Ser. No. 364,812 filed Apr. 2, 1982 which are herein expressly incorporated by reference.

The unit injector 10 as described herein and in the above referenced patent and patent application have four distinct modes of operation. One of these modes of operation being a pre-injection timing phase wherein the pumping plunger 100 is moved downwardly by a cam mechanism (not shown). To adjust the moment of injection of fuel through the nozzle 80, the length of the hydraulic fluid link between the pumping plunger 100 and the metering piston 50 is varied by permitting the fuel within the timing chamber 20 to be pumped therefrom by the downward motion of the pumping plunger 100. The length of the hydraulic fluid link is proportional to the time at which the valve 12 is activated thereby prohibiting additional fuel to be pumped from the timing chamber 20. It is beneficial if the fuel pulse created by this downward motion does not perturb the supply line flow and/or pressure. Consequently, the present invention includes a three-way valve means 110 which in one embodiment comprises two check valves 112 and 114. The check valve 112 is lodged between the supply line 14 and the control valve 12. More particularly, the check valve 112 is positioned within a passage 120 and 124 which permits fuel to flow from the source into the valve. However, when the high pressure seat 126 of the valve 12 is open to permit fuel to flow from the timing chamber 20 to control the valve 12, the pressure within the passage 124 will cause the check valve 112 to seat thereby prohibiting the fuel pulse to migrate into the supply. During this interval, fuel also flows to the timing chamber 20 from supply through the high pressure seat 126. The second check valve 114 of the three-way valve means connects passage 124 with the drain line 64. In the embodiment shown, this check valve 114 may be a spring loaded check valve. The check valve 114 is positioned to prohibit flow from the drain into passage 124 but permits fuel to be dumped from the timing chamber 20 into the drain, thus isolating the supply from flow and pressure perturbations. In this manner, the unit injector 10 is provided with a self-actuating three-way valving mechanism 110 which isolates the supply from the above-mentioned perturbations. The spring **114*a*** is optional for configurations using a high pressure drain.

Reference is now made to FIG. 2 which illustrates an alternate embodiment of a self-actuating three-way check valve which is generally shown as 130. The check valve 130 may be incorporated within the body of the unit injector 110 in communication with passages 64, 120 and 124. The check valve 130 comprises two adjacent cylindrical passages 132 and 134. Passage 134 communicates the supply to the control valve passage 124 and contains a restriction 136. The purpose of this restriction is to create a flow dependent pressure differential to cause a sliding piston 138 to move as detailed below. The first passage 132 has received therein a sliding piston 138 which is free to move in one position to seat upon a stop 140. In this first position the sliding piston 138 closes off communication to the drain line 64. This condition is achieved when fuel flows from the supply 120 into the timing chamber. During the pre-injection phase of operation, that is when the fuel flows from the timing chamber 20, the orifice 130 creates a pressure differential across the sliding piston 130, a portion 141 of which is exposed to passage 124 and the pressurized fuel flowing from the timing chamber 20 to thereby slide the piston 138 to a second condition against another stop 142 formed by a lower portion of passages 132 therein closing off communication between the valve 12 and supply and permitting fuel to flow to the drain 64 such that the timing chamber fuel does not perturb and generate supply line pressure dynamics.

Reference is now made to FIG. 3 that illustrates a further alternate embodiment of the three-way valve means generally designated as 150. The valve 150 communicates between the supply 120, dain 64 and valve passage 124. The valve includes a central chamber 152 having positioned therein a flat check plate 154 that is slidably received within the walls of the chamber 152. The chamber 152 contains a plurality of shoulders which defines a first and second stop 156 and 158. The flat check plate further includes an orifice 160 thereon such that when the flat plate 154 is against its stop 158, the orifice is aligned to the passage 124. In this manner, fuel may flow from passage 120 through to passage 124. It is contemplated that the flat check plate 154 can be keyed or otherwise not circular to prevent if from rotating. The check valve 150 further includes a wall 162 separating passage 124 and the drain 64. The end 164 of the wall 162 is even with the shoulder 158 such that when the flat check plate 154 is seated thereon flow is prohibited from passage 124 to the drain 64. To achieve the requisite pressure differential across the flat plate 156, the area of the orifice 164 is smaller than the remaining area of the check plate 154. It is desirable that the pressure of the drain line be substantially lower than that of the supply pressure when using the check valves 130 and 150. It should be noted that the dual check valve implementation shown in FIG. 1 will work with either high or low pressure drain lines. In addition, the pre-load spring of check valve 114 will only be required in those instances when the drain pressure is designed to be lower than that of the supply pressure.

Returning now to FIG. 3, in operation when fuel flow is from the supply to passage 124, the pressure differential created across the orifice 160 will urge the flat check plate 154 against the shoulder 158 and the end 164 to close off the drain line and permit flow through the orifice 160 into the passage 124 to the control valve 12. During those instances when pressurized fuel flows out from passage 124, the flat check plate 154 will be moved downwardly as viewed in FIG. 3 permitting fuel to flow between passages 124 and the drain 64, therein again isolating the supply from pressure perturbations.

Many changes and modifications in the above-described embodiments of the invention can, of course, be carried out without departing from the scope thereof. Accordingly, that scope is intended to be limited only by the scope of the appended claims.

Having thus described the invention, what is claimed is:

1. A unit injector of the type having a timing chamber defined between a pumping piston and a metering piston, a metering chamber defined below the metering piston, a plurality of passages including a valve passage therein for communicating fuel thereto and a drain line;

a single electrically controlled valve connected to the valve passage responsive to control signals for controlling the flow of fuel at least between a fuel supply and the timing chamber;

a nozzle situated remote from the metering chamber and passages to communicate fuel to be injected therefrom the metering chamber to the nozzle and dumping means to periodically relieve the pressure within both the timing and metering chambers, the improvement comprising self-actuating check valve means to permit fuel to flow from the supply to the valve passage and control valve in one condition and for permitting fuel within the timing chamber during a pre-injection mode of operation characterized when the pumping piston is descending, wherein fuel is being forced from the timing chamber to flow through to drain for isolating the supply from the pressure line perturbations generated by the venting of fuel from the timing chamber and to permit in another condition fuel to flow from the supply to the timing chamber.

2. The unit injector as defined in claim 1 wherein the check valve means comprises a first check valve for permitting fuel to flow from the supply to the valve passage and the control valve and further including a second check valve for permitting fuel to flow from the control valve, valve passage to the drain line.

3. The fuel injector as defined in claim 1 wherein the second check valve is spring loaded to prohibit fuel flow from the drain to the control valve.

4. The fuel injector as defined in claim 1 wherein the check valve means comprises a plurality of passages, one of which houses an orifice to communicate fuel between the supply and the valve passages, a second passage housing a sliding piston and a first and second stop, the second passage communicating between supply, the valve passage and said drain, wherein when the sliding piston is lodged on the first stop, the piston terminates communication between supply and the drain and when the sliding piston is urged against the second stop fuel flow between the valve passage and the supply is prohibited.

5. The fuel injector as defined in claim 1 wherein the check valve means includes a chamber defining a first stop and a second stop, and slidable flat check plate slidably received within the chamber and responsive to the pressure differential thereacross for selectively seating in one condition on said first stop and in a second condition on said second stop, said flat check plate further including an orifice in alignment with said valve passage, said chamber communicating with the supply and communicating opposite the supply connection to said valve passage and drain wherein when said flat check plate is in said one condition communication between said valve passage and drain is terminated.

* * * * *